US009035482B2

(12) United States Patent
Hui et al.

(10) Patent No.: US 9,035,482 B2
(45) Date of Patent: May 19, 2015

(54) SPIRAL TURBINE OPERATING ON PRESSURE PRINCIPLE

(71) Applicants: Joseph Y Hui, Fountain Hills, AZ (US); James M. Hussey, III, Chandler, AZ (US)

(72) Inventors: Joseph Y Hui, Fountain Hills, AZ (US); James M. Hussey, III, Chandler, AZ (US)

(73) Assignee: MONARCH POWER CORP., Scottsdale, AZ (US)

( * ) Notice: Subject to any disclaimer, the term of this patent is extended or adjusted under 35 U.S.C. 154(b) by 0 days.

(21) Appl. No.: 14/201,572

(22) Filed: Mar. 7, 2014

(65) Prior Publication Data

US 2014/0252772 A1 Sep. 11, 2014

Related U.S. Application Data

(60) Provisional application No. 61/775,133, filed on Mar. 8, 2013.

(51) Int. Cl.
*F01D 15/10* (2006.01)
*F01D 1/32* (2006.01)

(52) U.S. Cl.
CPC ..... *F01D 1/32* (2013.01); *F05D 2250/15* (2013.01)

(58) Field of Classification Search
CPC ..... F01D 1/32; H02K 7/1823; F05D 2250/15
USPC ..... 290/52
See application file for complete search history.

(56) References Cited

U.S. PATENT DOCUMENTS 1,329,626 A * 2/1920 Oman ..... 415/80

FOREIGN PATENT DOCUMENTS

WO WO 2013/084036 A1 * 6/2013

* cited by examiner

*Primary Examiner* — Tho D Ta
(74) *Attorney, Agent, or Firm* — Robert C. Klinger

(57) ABSTRACT

An apparatus of a gas turbine for the purpose of converting the pressure and temperature energy of a gas into rotational kinetic energy of a turbine; through an axial injection of such gas into the center of flat disks to perform work as the gas moves outward in one or more spirals cut out of these flat disks; such that the gas experiences a gradual release of pressure along the length of the spirals as the gas presses down on the width and length of the spiral; with the spiral being of many turns such that the radius of the spiral is a prescribed increasing function of turns of the radius; and the spiral has a long length in the order of a meter, a moderate width in the order of a centimeter, and a shallow depth being a small fraction of a millimeter.

11 Claims, 7 Drawing Sheets shows an exploded view of the turbine with gas injector, spirals, and end plates

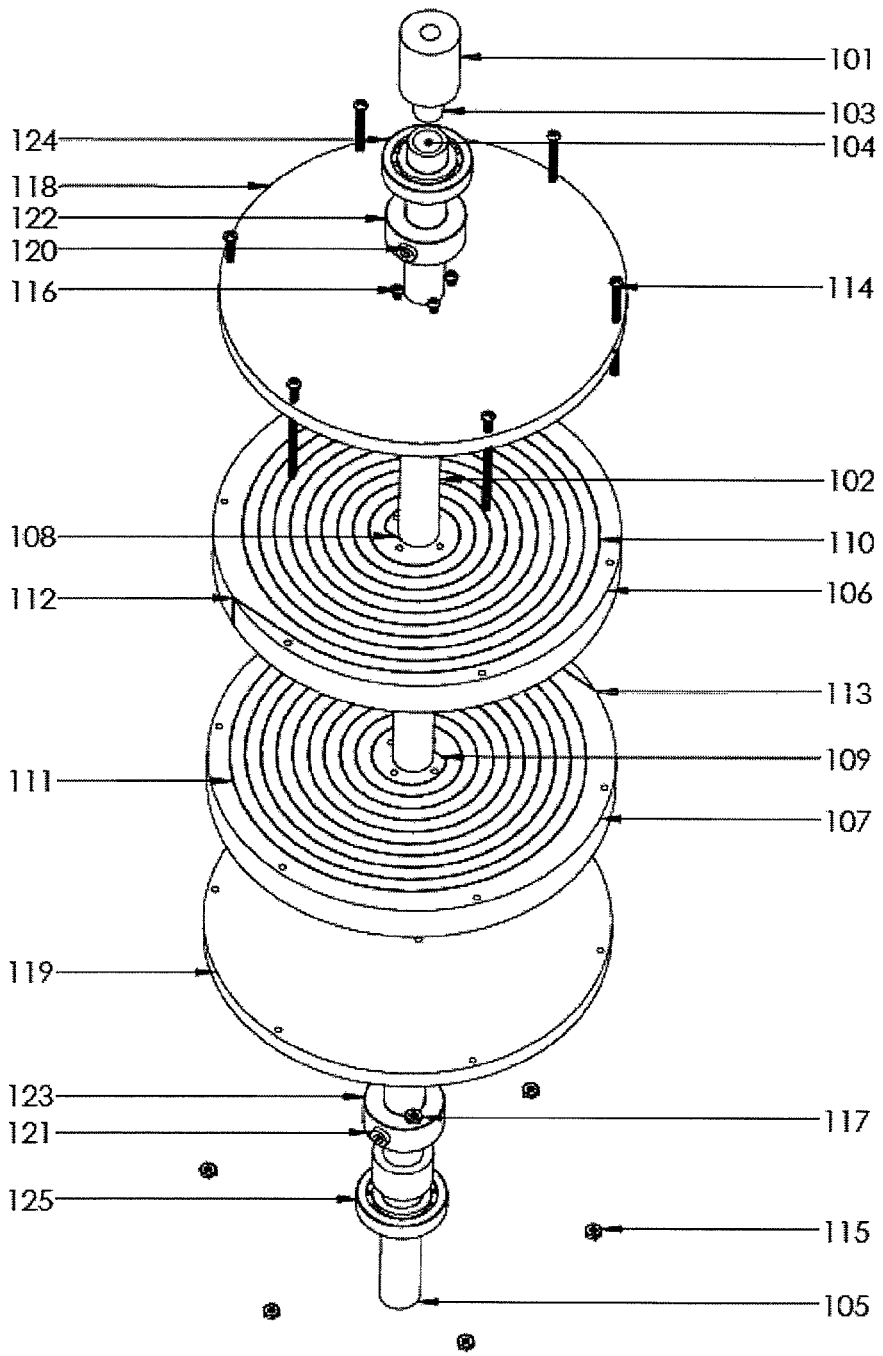
Fig. 1 shows an exploded view of the turbine with gas injector, spirals, and end plates

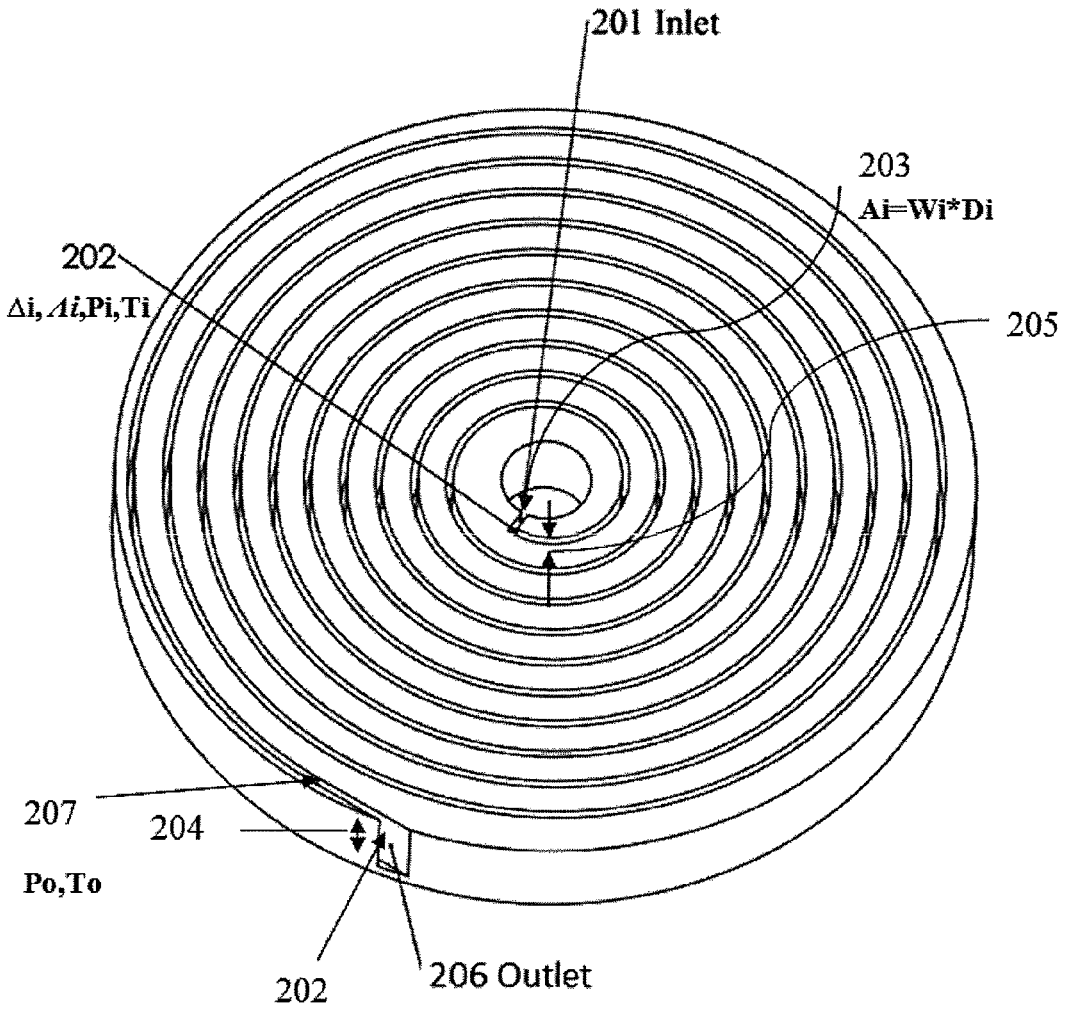
Fig. 2 shows a single 10-turn spiral with linearly increasing radius versus turn

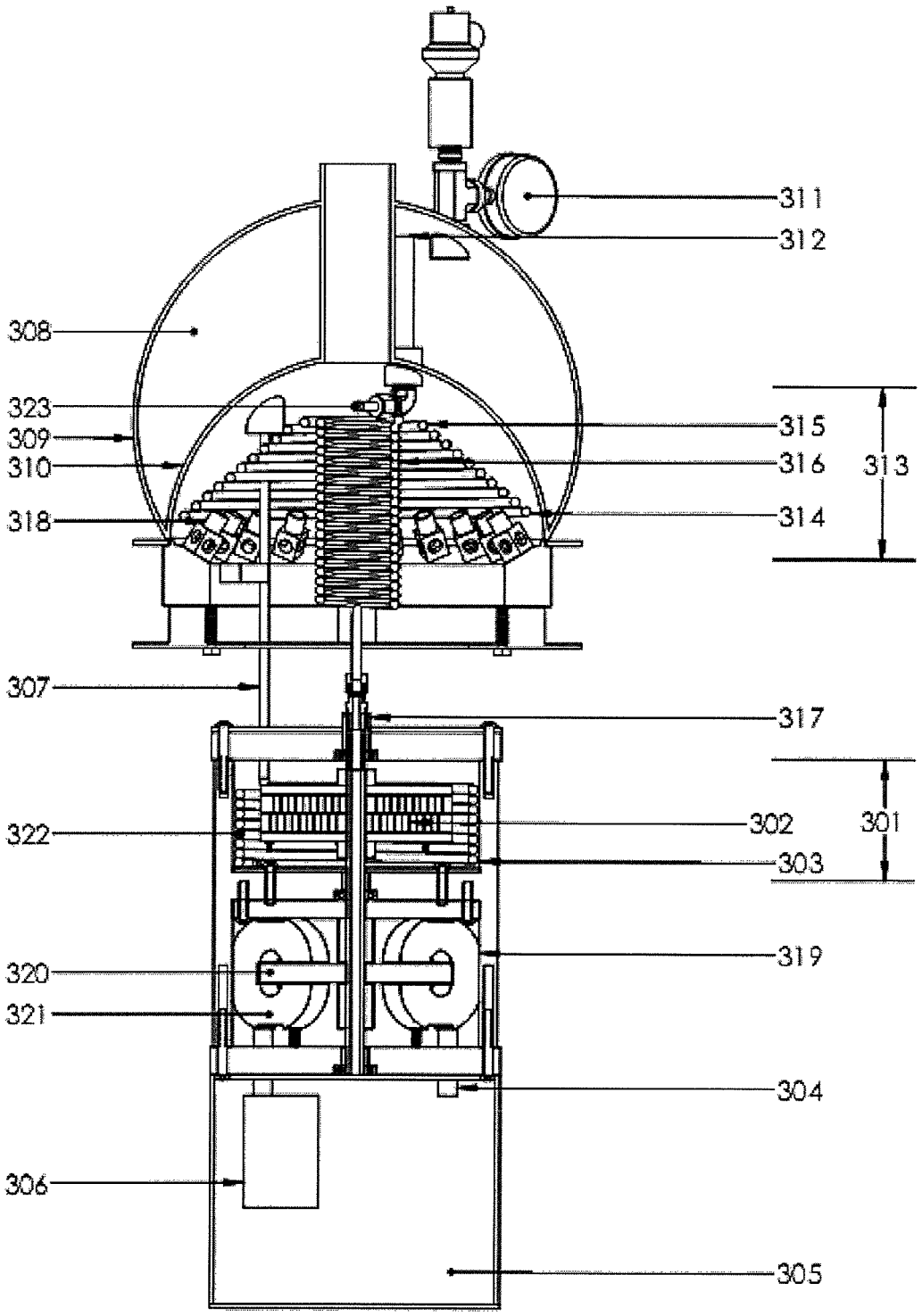
Fig. 3 shows the closed cycle of fluid pumping, heating, and working of the Rankine cycle

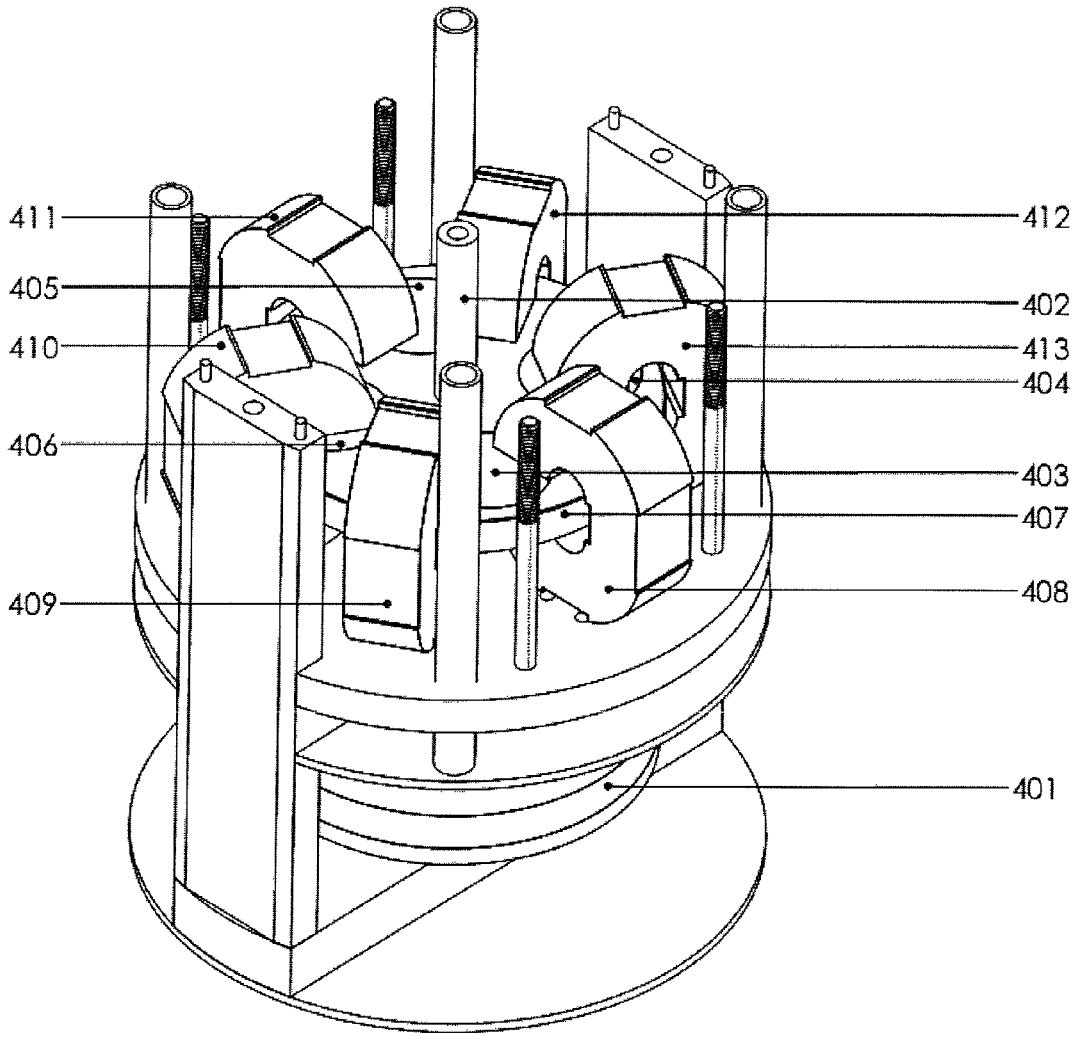
Fig. 4 shows coupling of the turbine to a synchronous permanent magnet motor for generation

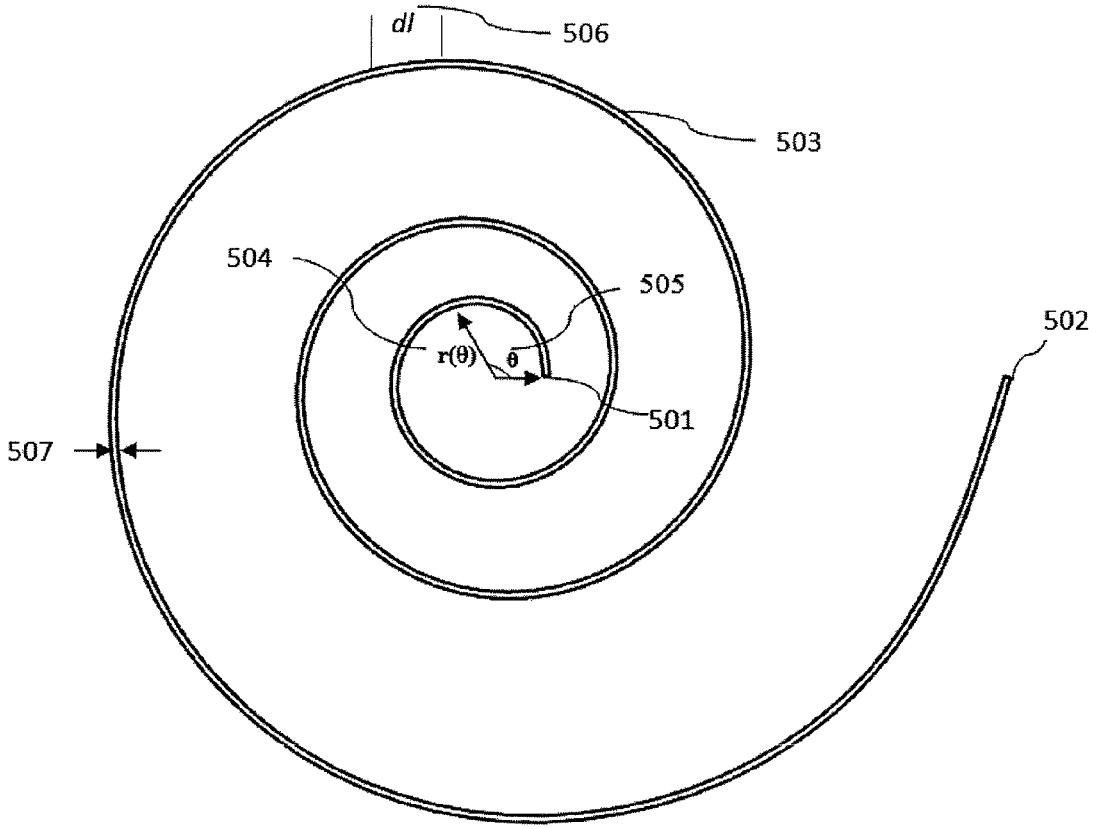
Fig. 5 shows the functional shape of the spiral for radius versus turn

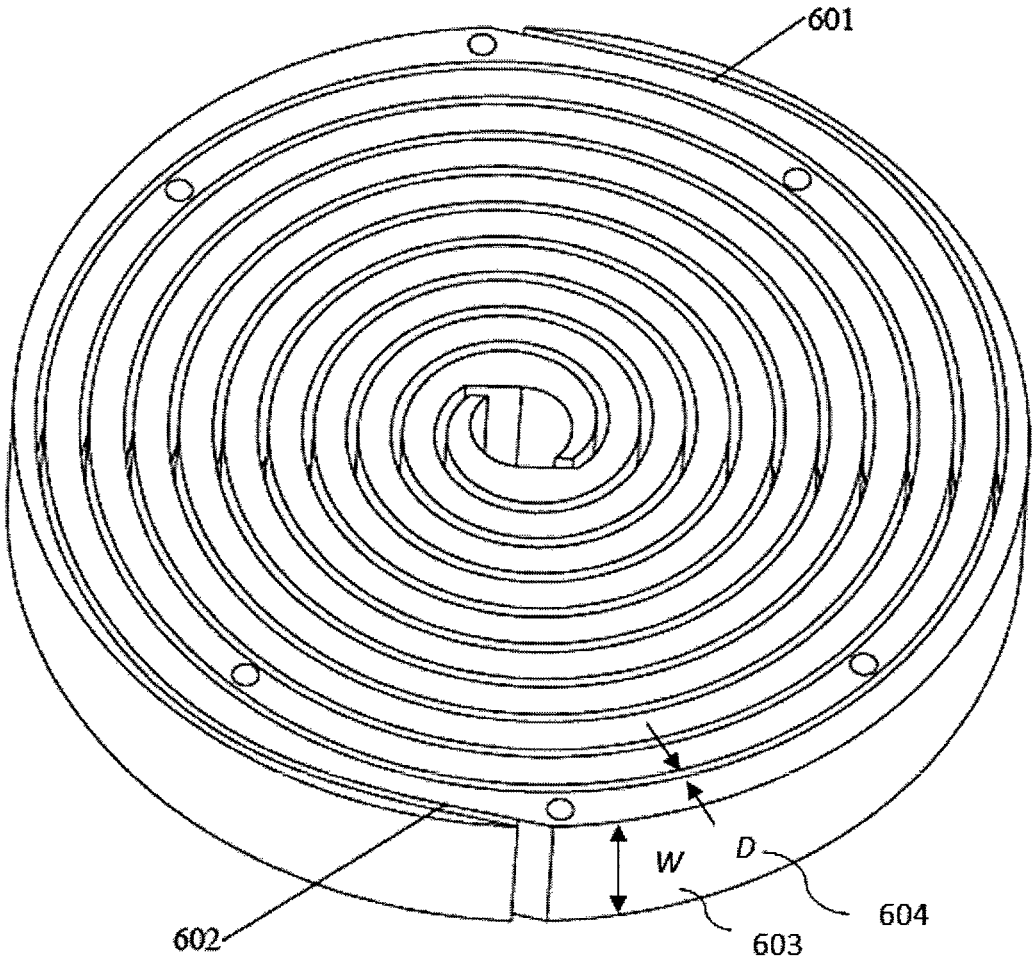
Fig. 6 shows two 5-turn spirals with linearly increasing radius versus turn

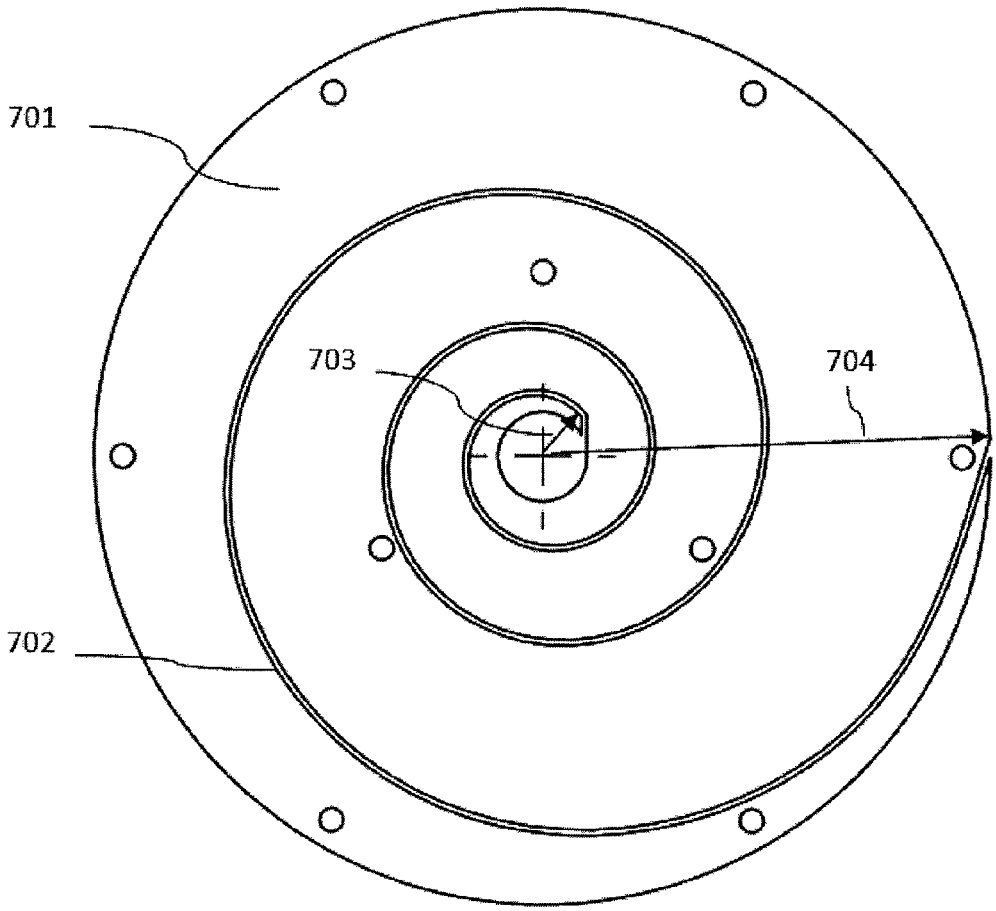
Fig. 7 shows a three 3-turn spiral with an exponentially increasing radius versus turn

SPIRAL TURBINE OPERATING ON PRESSURE PRINCIPLE

CLAIM OF PRIORITY

This application claims priority of U.S. Provisional Patent Application Ser. No. 61/775,133 entitled SPIRAL TURBINE OPERATING ON PRESSURE PRINCIPLE filed Mar. 8, 2013, the teachings of which are included herein in their entirety.

BACKGROUND

We propose a new turbine design using the pressure principle, forcing high pressure gas through long and shallow spirals of many turns. The gas performs work on long spirals of moderate width and very shallow depth. A gradual and close to linear drop of pressure occurs along the length of the spirals when the spirals are turning at a moderate angular velocity. Adiabatic expansion of the gas occurs gradually as the gas turns in the spiral, making the process more or less isentropic.

The slow expansion is unlike the rapid expansion of impact or reaction turbines, which instantaneously convert all pressure energy into kinetic energy as the gas expands through a diverging nozzle. This rapid expansion converts most of the pressure and heat energy of the gas into high speed gas flow, which can sometimes reach supersonic speed. Momentum of the gas flow is imparted to the turbine through impact on turbine blades. The impact makes the blade rotate around an axle. Many such blades together cause the turbine rotor to turn at a high speed. The disadvantage of the reaction or impact turbine is that the kinetic energy of the high speed gas is often reconverted back into heat, causing entropic losses to the heat engine. Our disclosure avoids entropic inefficiency by having the gas retain its pressure, as the gas works along a long spiral of moderate width and very shallow depth.

The advantages of our turbine are many. First, we have improved conversion efficiency of heat into kinetic energy. Second, the turbine is scalable in power by widening the spiral or by increasing the number of spirals in a stack of disks. Multiple flat disks can be bolted together to increase power capacity of the turbine. Third, we have simplicity of manufacturing. The spirals are mechanically cut by modern high precision techniques such as wire Electrical Discharged Machining (wire EDM). Fourth, the rotational speed of the turbine is much reduced, in the order of a thousand revolutions per minute (rpm), instead of the typical tens of thousands of rpm for a modern turbine.

This lower speed allows the turbine axle to be directly coupled to an induction or synchronous generator without the use of gears to reduce the rpm. The reduced rpm allows the turbine to be synchronized with 60 Hertz alternating current for easy phase tying of the electrical output of a synchronous poly-phase generator to the electric power grid. We shall describe how the turbine can be directly coupled into a synchronous poly-phase permanent magnet generator. Alternatively, we may use a poly-phase induction generator.

This small, simple, and economical turbine is suitable for power conversion using concentrated solar power as the heat source. Highly focused sunlight produces high temperature and pressure steam to drive the turbine. We describe also how we may use a fossil fuel such as natural gas to generate high temperature and pressure steam. Steam is injected into the center, instead of the periphery of the rotor. This central injection requires a special coupler for flowing steam into the turbine.

There are other gas turbines or steam engines that are more efficient than impact or reaction turbines, such as the Watts steam engine using positive displacement of a piston, or the industrial gas turbine using lift of turbine blades that resemble air-foils. These engines are typically of a large size, noisy, comprise a large number of parts, and may rotate at high speed. This disclosure, through cutting spirals in solid disks of metal, creates a turbine that has very few parts, costs less to manufacture, and is failsafe. This disclosure therefore achieves the purpose of creating small and simple turbines which are as efficient as the large gas turbines. The turbine is suitable for small solar or thermal energy sources.

We give a more detailed historical development of turbines and steam engines in the remainder of this background survey.

Turbines are rotary machines that absorb energy from or impart energy to a moving fluid. Turbines are the subject of invention since antiquity. For example Hero invented a rotary boiler that ejected steam from two nozzles in opposite directions at the two ends of a diameter. The boiler spins in reaction to the steam ejected. The Hero turbine works by the principle of mechanical reaction.

Archimedes invented the famous Archimedes screw that uses rotary motion of a cork screw inside a cylinder to lift water. The Archimedes screw works by the principle of mechanical impact, imparting lift to water by the turbine blade. Many hydro-electric stations nowadays use the same impact or impulse principle for the reversed process of moving the turbine. Falling water makes impact on the turbine, turning the turbine which in turn drives an electrical generator.

Numerous turbines have been invented since the industrial revolution to convert heat, pressure, or motion power of a gas to perform industrial work or generate electricity. Here we cite a few notable inventions based on distinctive motive principles. First we note the Navier-Stokes equation $$\rho\frac{Dv}{Dt} = -\nabla p + \nabla \cdot T + f$$

which relates the density of the gas ρ, gas velocity vector v, gas pressure p, stress tensor T on the gas, and body force vector f on the gas through differential operators. The Navier-Stokes equation is the gaseous analog of Newton's second law of motion Ma=F, which states that the force F acting on a mass M would produce acceleration a=F/M. The material derivative $$\rho\frac{Dv}{Dt}$$

on the left of the Navier-Stokes equation is analogous to the term Ma in Newton's second law, whereas the three terms on the right of the equation represent the internal and external forces acting on the gas causing kinetic variation of the gas. The first term $-\nabla p$ relates to the spatial gradient of change in the gas pressure. In our disclosure here, we want the gradient to be small as pressure drops continuously and slowly along the length of the spiral. The second term $\nabla \cdot T$ relates to the stress force tensor T on the gas such as that caused by viscosity. This term is significant in the Tesla turbine but insignificant within our spiral turbine as the gas flow is not laminar. The last term f is the reaction of the turbine on the gas. The action of the gas on the turbine causes the turbine to spin, and in the process the heat and pressure energy of the gas is changed into kinetic energy.

Reaction turbines work when superheated and high pressure gas is forced through a De Laval nozzle. Most of the heat and pressure energy of a gas is converted within the short nozzle neck into a high speed and often supersonic jet of low pressure and temperature. In other words, $-\nabla p$ changes rapidly within the nozzle only. The ejected gas provokes an equal and opposite reaction of the nozzle. Unfortunately, reaction turbine often spins at a dangerous speed of more than 10,000 revolutions per minute (rpm) while providing very little torque.

Impact or impulse turbines have stationary nozzles, for which high speed gas from a nozzle is forced to impact rotary turbine blades. Impact turbines also tend to turn at a very high speed with little torque. Impact turbines often are noisy when high speed gas hits the blades. Worse, impact turbines often have low efficiency as a high speed jet rapidly loses kinetic energy in turbulent impact with ambient air or turbine blades.

Most of the world's electricity is generated by steam turbine working on the principles of the Rankine engine. The modern steam turbine has alternating stages of rotating blades and static flow directors. High pressure and temperature steam enters a rotary turbine. Both the steam turbine and the wind turbine operate by the lift principle similar to that of an airplane wing. As gas accelerates on the upper surface of a wing, the lower surface experiences a lift due to higher pressure exerted by the slower flowing gas. Thus the turbine blade is forced to rotate by the aerodynamic lift. The flow exiting the turbine blades are redirected by a static channel. The redirected gas flow then hits at a correct angle on a second stage of turbine blades. The process of redirection and lift repeats for subsequent stages of turbine blades.

The high efficiency of the lift turbine is due to a non-turbulent flow of gas lifting the turbine blades, without a direct entropic impact on the turbine blades. The gas flows slowly pass the blade, expanding slowly while yielding a small part of its pressure to lift the blade. The slightly depressurized gas with lowered temperature can perform further work on the next stage of turbine blades. For modern combination cycle gas turbines, more than 60% of the heat energy from burning natural gas can be converted into mechanical work or electrical power.

Modern steam or gas turbines are powerful, large, and efficient. Unfortunately, they are complex, comprising of many moving parts rotating at high speeds. These turbines are therefore expensive to make and difficult to maintain.

The burning of fossil fuels for large centralized power generation generates billions of tons of carbon dioxide each year, causing global warming and depletion of fuel resources. Distributed renewable power generation, such as that provided by small solar thermal collectors or household heat sources, requires turbines that are small, simple, efficient, cheap, and reliable. Such turbines are yet to be made available on a large scale.

Our disclosure achieves these goals, using a distinctly novel spiral turbine based on the pressure and temperature principle. There are engines that perform work based on the pressure principle, such as the positive displacement of pistons for the classical steam engine of James Watt. Rotary steam engines use rotary vanes for rotation, unlike the Watts steam engines that use a crankshaft and flywheel to turn the linear motion of a piston into rotary motion.

These positive displacement engines are not as efficient as the modern gas and steam turbines, as gas flow is not smooth. Valves, crankshafts, seals, and flywheels operate sporadically. They are difficult to build and maintain at high temperature, pressure, and frequency of motion.

Our disclosure is distinctly different from these positive displacement engines, which operate by injecting a fixed volume of high pressure gas into a closed chamber and then allowing the gas to expand and push a piston or vane. Our gas flow is continuous and open, with no valves, piston, or closed housings. Due to the continuous and smooth gas flow, our invention has the advantage of smooth power delivery and balanced motion.

The Tesla turbine invented a century ago is re-emerging as a small form factor turbine for renewable power generation. The Tesla turbine works by aerodynamic drag resulting from the viscosity of a flowing gas. Gas is injected into the periphery of a stack of circular disks. The gas flows continuously between the disks, spiraling towards the center of the stack which serves as the gas exhaust. Drag force $\nabla \cdot T$ corresponds to the second term on the right hand side of the Navier-Stokes equation $$\rho \frac{Dv}{Dt} = -\nabla p + \nabla \cdot T + f.$$

The viscosity of the gas drags the disks, causing the stack to rotate in the same direction of the gas rotation. Gas flow is laminar between adjacent disks, with higher velocity midway between disks than at the surface of the disks. This laminar flow creates viscous drag on the disks as described by the Navier-Stokes equation.

Nicolas Tesla faced initially the problem of high spin velocity exceeding 10,000 rpm for his Tesla turbine. The high spin velocity of gas flow, coupled with less advanced machining and material technologies then, made the Tesla turbine less efficient and difficult to make. Since then, gas and steam turbine with rotary blades have become the dominant engine used for industrial power generation.

Our disclosure is distinctly different from the Tesla turbine. Besides using the pressure principle instead of viscous drag, the mechanical structure is different. For our turbine, gas flows from the disks center to the peripheral of the same disk in guided spirals, while the Tesla turbine flows between disks from peripheral to the center. For our turbine, gas flows in reverse direction of the turbine spin, as spin is caused by a reaction of the turbine to gas pressure.

For the Tesla turbine, gas drags the turbine along in the same direction. The viscous drag is acting on the disk surfaces, which are perpendicular to the spin axle of the Tesla turbine. For our turbine, the gas presses against the width of the flowing channel circumferential to the spin axle. The Tesla turbine requires housing for the spinning stack of disks to contain the gas on the circumference, while the gas spirals towards the center to exit. Our turbine requires gas to enter through a spinning axle to work against a spinning spiral on its way out at the periphery of the disks. Although specific advantages have been enumerated above, various embodiments may include some, none, or all of the enumerated advantages. Additionally, other technical advantages may become readily apparent to one of ordinary skill in the art after review of the following figures and description.

SUMMARY

Our disclosure is directed to a spiral turbine operating on pressure principle. It achieves simplicity through unity. There is only one moving part, namely the turbine itself comprised of one or more disks with spiral channels. There is no housing needed as in the case of the Tesla turbine or the lift turbine to contain the high temperature and pressure gas at the inlet. Housing may be needed at the gas outlet to contain the gas of a lower temperature and pressure. No nozzle is needed to generate a reactionary force from the speeding gas.

Our disclosure is economical to build and maintain. Carefully controlled flow channels can be easily cut into a disk by computer numerical control (CNC) machinery. Alternatively, we may cut the spirals by laser, high pressure water jet, or wire EDM. Stacks of such disks could be bound together with nuts and bolts. Gas is let in through a stationary male inlet through the female hollowed spin axle in the center of the stack. Gas performs work on the width and length of the spiral as it makes its way towards the exit on the peripheral.

A key objective of the current disclosure is to avoid the highly entropic process of the rapid heat and energy conversion of a gas and its turbulent impact on a turbine. Our turbine continuously and gradually converts the heat and pressure of a gas through long and high impedance spiraling flow channels. The spiral inside the disks are of microscopic sub-millimeter depth, exerting pressure on a wider flow channel of around a centimeter width, allowing for gradual work to be done over a torturously long spiral of a length up to a meter. The key is the creation of a flow channel with significant flow impedance for gradual release of gas pressure.

We summarize one embodiment of the disclosure as: An apparatus of a gas turbine for the purpose of converting the pressure and temperature energy of a gas into rotational kinetic energy of a turbine; through an axial injection of such a gas into the center of a stack of one or more flat disks to perform work as the gas moves outward in one or more spirals cut into these flat disks; such that the gas experiences a gradual release of pressure along the spiral path as the gas presses down on the width and length of the spiral; with the spiral being of many turns such that the radius of the spiral is a prescribed increasing function of turns of the radius; and the spiral has a long length in the order of a meter, a moderate width in the order of a centimeter, and a shallow depth being a small fraction of a millimeter.

BRIEF DESCRIPTION OF THE DRAWINGS

For a more complete understanding of the present disclosure and its advantages, reference is now made to the following description taken in conjunction with the accompanying drawings, in which like reference numerals represent like parts, wherein:

FIG. 1 shows an exploded view of the turbine with gas injector, spirals, and end plates;

FIG. 2 shows a single 10-turn spiral with linearly increasing radius versus turn;

FIG. 3 shows the closed cycle of fluid pumping, heating, and working of the Rankine cycle;

FIG. 4 shows coupling of the turbine to a synchronous permanent magnet motor for generation;

FIG. 5 shows the functional shape of the spiral for radius versus turn;

FIG. 6 shows two 5-turn spirals with linearly increasing radius versus turn; and FIG. 7 shows a three 3-turn spiral with an exponentially increasing radius versus turn.

DETAILED DESCRIPTION

The rotary part of the turbine, comprising of various components, is shown exploded in FIG. 1. A gas inlet 101, which is stationary, leads steam from the boiler into the hollow spin axle 102 of the steam turbine. In our experiments, we learned that the gas inlet should be a male component 103 while the reception of gas in the spin axle should be female 104 for the inlet 103, in order that the leaking of gas from the inlet to the outside environment forms a gas bearing to prevent the binding of the spin axle to the inlet.

The high pressure and temperature gas continues to flow down the spin axle 103, albeit some may have leaked at the coupling of the gas inlet and the spin axle, acting beneficially as a gas bearing. The spin axle is closed at the other end 105, while gas enters the two disks 106 107 at the inlets 108 109. The two disks 106 107 each have a spiral 110 111 cut, which could be performed by means of wire EDM. The disks have their spirals off by half a cycle, in other words the inlet 108 is diametrically opposite to the inlet 109. The circular symmetry of the spirals balances the weight of the disks. Also, gas is ejected at the outlets 112 113 on opposite sides on the two disks 106 107. This balanced gas ejection makes the turbine spin smoothly.

The various plates in FIG. 1 are assembled together by means of six bolts 114 and nuts 115 in the perimeter, as well as four bolts 116 and nuts 117 close to the axle. These bolts and nuts are placed so that the holes through the spiral disks 106 107 do not penetrate through the spirals. The top plate 118 and bottom plate 119 serve as end caps to the spiral disks. Note that the adjacent spiral disks or end caps for each of the spiral disk serve to contain the spiraling gas along the depth of the spiral. The design makes the spirals easy to cut and yet the gas is prevented from leaking along the depth of the spiral.

The hollow spin axle 102 penetrates each plate through a hole in the center of the plate. The axle has a slit along the width of the spiral at the center, allowing the gas to exit from the hollow center to the spiral. The axle needs to be anchored to the plates, through the two set screws at the top 120 and at the bottom 121. The set screws lock onto the axle through the shaft collars 122 and 123 which are glued to the top and bottom plates.

The rotary components are assembled as one rotary piece of the turbine, which is then affixed to the stationary housing for the turbine. Three elements affix the rotor, including the input nozzle/inlet 101 103, the bearing 124 at the top, and the bearing 125 at the bottom. The bearings and inlet allow for smooth rotation of the rotor.

A single disk is shown in FIG. 2, which also shows the operating conditions of the gas. At the spiral inlet 201, the gas has input operating conditions 202 of pressure Pi, temperature Ti, density $\Delta i$, and speed $\Delta i$. The inlet area 203 is $\Delta i=(Wi-Di)$, where Wi 204 is the width of the inlet and Di is the depth 205 of the inlet. Thus the volumetric density of the gas energy is given by $Ei=Pi+\frac{1}{2}\Delta i\Lambda i^2$. The first term Pi is due to the pressure generated when heated gas molecules exert force on boundaries. By the ideal gas law, we have $PV=nRT$ in which n is the number of moles of gas, V is the volume of the gas, and R is the universal gas constant. The ideal gas law shows that pressure $P=(nR/V)T$. Therefore pressure is a product of the temperature T and molar density nR/V. The power of the flowing gas is given by $\Pi i=Ai\Lambda iEi$, which is the input thermal power to the turbine.

The gas works its way through many turns of the spiral, with operating parameters 202 of pressure P, temperature T, density $\Delta$, and speed $\Lambda$ of the gas. The parameters P, T, and $\Delta$ drop gradually throughout the length of the spiral. The manner of these drops depends on how fast the spiral is spinning, which is discussed later when we consider the fluid and thermal dynamics of the gas. The speed of the gas Λ may speed up, hopefully not by much as our turbine operates by pressure, not by the speed of the gas.

The gas exits the turbine disk as it spirals outward at the outlet 206. The energy of the gas is spent, as characterized by the parameters 207, by pressure Po, temperature To, density Δo, and velocity Λo. The outlet area is Ao, Ao=(Wo−Do), where Wo is the width of the inlet and Do is the depth of the inlet. We may assume Ao=Ai as the width and depth are constant throughout the spiral, namely that Wo=Wi and Do=Di. The volumetric density of energy of the spent gas is given by $Eo=Po+\frac{1}{2}\Delta o\Lambda o^2$. The power of the gas flowing out of the turbine is given by Πo=AoΛoEo. The difference of the gas power between the input and output is Π=Πi−Πo=AiΛiEi−AoΛoEo. If the heat loss from the gas to the turbine is ignored, the ideal kinetic power output of the turbine is approximated by this difference H, as power loss of the gas is converted into kinetic energy of the turbine.

The key to thermodynamic efficiency of the turbine is that throughout the process, gas maintains a low kinetic velocity from inlet to outlet, while pressure drops constantly throughout the length of the spiral. This is achieved only when the spirals are spinning at a nonzero angular velocity Ω relative to the axle, when there is a certain optimal velocity of spin Ωo when the kinetic power output is optimized with a fairly constant rate of pressure drop along the entire length of the spiral. We shall discuss further the fluid dynamics of pressure drop relative to spin velocity later, in accordance with the Navier-Stokes equation.

The gas flow of the turbine is discussed by means of statistical mechanics. As the gas spirals outward, gas molecules are forced to change course by the outside of the spiral, thereby impinging an equal and opposite reaction on the spiral, causing the spiral to turn. When the spiral is turning, the gas molecules on average lose kinetic energy and therefore cool. At no point in our turbine the gas undergoes a conversion of random heat motion of the gas into systematic motion, such as that of a restricting rocket nozzle that almost instantly converts pressure and heat into a cooler and fast flowing gas stream. This conversion should be avoided as a fast jet of gas rapidly becomes chaotic in ambient atmosphere or upon impact on a turbine blade, which is a highly entropic process when the gas becomes heated up again. Ideally, the exiting gas should have a pressure of 1 atmosphere and a temperature as low as possible. In the case of using steam as the gas for driving the turbine, the steam exiting the outlet should remain as a gas, and therefore at 1 atmosphere should have a temperature above 100 degrees Celsius.

The entire Rankine Cycle for the gas turbine is shown in FIG. 3, comprising the 4 steps of pumping, heating, working, and condensing of the gas. The turbine 301, with spiral cross sections seen as vertical lines 302, is housed in a case 303 to contain the exiting gas from the side of the turbine. The condensing steam is then passed through cooling pipes 304 to a sump 305 for holding the condensed water. A high pressure and low volume pump 306 is used to transport water up the pipe 307 into the boiler 308. Prior to entering the boiler, this water is preheated by the exiting gas from the turbine inside the turbine case, as water is circulating in the coils of the heat exchanger 322. The turbine case, while containing the exiting gas, also serves as a heat exchanger. The heat exchanger raises the efficiency of the turbine. The high pressure pump raises the pressure of the boiler to Pi. In our implementation of the boiler, water is contained within the upper hemispheric shell 309 and a smaller lower hemispheric shell 310.

The pressurized water boils within the boiler 308 at an elevated boiling temperature, producing saturated steam. At 20 atmospheres of pressure, water boils at around 200 degree Celsius. The sensor 311 measures the temperature and pressure of the saturated steam from the boiler. The saturated steam exits the boiler at the outlet 312. This saturated steam is carried by a tube to the bottom of a superheating coil 313 (comprising the coil sections 314 315 316). Steam circulates downward from the boiler through 323 to the bottom of the superheating coil at 314 through a tube (not shown in the cross section view). From the bottom 314, steam moves up to reach the smaller diameter 315. At the top 315, steam becomes superheated beyond its boiling temperature. To further superheat the steam to a temperature, steam flows down the cylindrical coil 316, bringing the gas inlet temperature up to as high as Ti=500 degrees Celsius. Steam now flows down towards the nozzle and inlet 317. The superheated and highly pressurized gas then performs work as gas passes through the spirals 302, thus completing the 4 steps of the Rankine heat engine cycle.

The heat source in FIG. 3 is assumed to be an open fire from burning a gaseous fossil fuel at the furnace nozzles 318. In another realization, the heat source is at the focal point of a parabolic mirror. We believe thermal generation of electricity can have a higher efficiency than photovoltaic generation. High temperature heat is conducive to producing high quality kinetic energy from the turbine, which is then converted to electricity through the electric generator 319. The generator comprises the rotor 320 and the stator 321. The residual heat can be used for heating, evaporative cooling, and water purification.

To convert the kinetic energy of the rotating turbine into alternating current electricity, FIG. 4 shows how the turbine 401 is coupled with a poly-phase synchronous permanent magnet motor/generator. The same spin axle 402 of the turbine is connected to the rotor of the AC generator, with 4 permanent magnets 403 404 405 406 of alternating magnetic poles on a disk 407. The stator is composed of magnetic coils wound around laminated steel plates shaped in the form of a C 408 409 410 411 412 413. The rotor and its alternating magnetic poles pass through the gaps of the C. A pair of C, say 408 411, comprises two C diametrically opposite to each other. The coils 408 411 are connected in series. One end of the coil is grounded, while the other end gives one pole of the three-phase AC current. The other two pairs (409 and 412; 410 and 413) generates the other two poles of the three-phase AC current.

The turbine disclosure is uniquely suitable for grid-tied electric generation. A key problem with impact or reaction turbines is the high rotational speed, given that the working gas is sped up through a nozzle, converting most pressure/heat energy into kinetic energy of the gas, sometimes at close to supersonic speed. Not only is the process highly entropic and noisy, the spin speed in tens of thousands of rpm requiring substantial gearing for sufficient torque to drive an electric generator.

Since the gas in our turbine maintains low speed and high pressure throughout the spirals, the turning speed can be easily controlled within the range of 1000 to 4000 rpm. Sufficient torque is produced as the gas presses down on a long spiral. No gearing down is needed for turning an electric generator, be it a synchronous permanent magnet motor or an induction motor.

Furthermore, the spinning of the turbine can be synchronized with the frequency and phase of the AC electric grid. The generator is now grid-tied, capable of pushing power back into the grid should there be residual power after consumption by household appliances. To understand this capability, we realize that an AC generator is identical to an AC motor. Thus a synchronous 6 pole permanent magnet motor has its rotor turning at 1800 rpm, half the rate of 3600 Hertz of the AC current. When a high temperature and pressure gas starts to flow through the spirals, the turbine begins to pull its phase ahead of the voltage. This phase change then turns the power factor from being positive (consumption of electric power) to being negative (generation of electric power). The motion induces an electric field with a leading phase in the stator coils. This leading phase pushes power into the grid.

Instead of using a permanent magnet synchronous motor, we can also use an induction three phase motor/generator. The stator part remains the same as that shown in FIG. 4. The rotor part is now inductive in generating a magnetic field, with inductive coils replacing the permanent magnets. In the simplest embodiment, the rotor is simply a round plate, where current loops are induced in the plate in reaction to the exciting coils in the stator. As we grid tie the motor/generator, the motor rotates as driven by the three phase power grid at less than 1800 rpm. The reduced rotational frequency relative to the 1800 rpm of the synchronous motor is a feature of inductor motor. As the high pressure and temperature gas drives the turbine, the rotational frequency of the turbine and motor increases to beyond 1800 rpm. As a result, power is pushed into the grid by the motor, which is now operating as a generator instead.

We now proceed to explain the thermodynamics of the gas flowing through a spinning spiral channel. The ideal gas equation is PV=nRT, relating pressure P, volume V, gas quantity n, and temperature T of the gas. The equation PV=nRT relates work energy PV to the thermal content nRT of the gas, a simple assertion of the conservation of energy. In the case of constant temperature T, Boyles' Law maintains a constant PV when there is thermal equilibrium of temperature.

In the case of reversible adiabatic processes, i.e. when no heat is exchanged between the gas and its environment and the process is isentropic, temperature drop is directly related to pressure drop according to the equation $P^{1-\gamma}T^{\gamma}$=constant. The adiabatic index is $\gamma=5/3$ for a mono-atomic gas, $\gamma=7/5$ for a diatomic gas, and for steam at higher temperature, $\gamma\sim1.3$. For diatomic gas, we have $P^2/T^7$=constant. Thus pressure drops much more quickly than temperature drops. In our turbine design, we may expect gas inlet temperature to be 800 degrees Kelvin (527 degrees Celsius). If the outlet gas drops to 400 degrees Kelvin (127 degrees Celsius) in temperature and 1 atmosphere in pressure, we would require the inlet gas pressure to be at $2^{7/2}$=11.3 atmospheres pressure. For steam, we have $p^{1.3/0.3}=T^{1.3}$=constant, the required inlet pressure is then $2^{1.3/0.3}$==20.16. Thus the use of high pressure is key to conversion of heat into systematic kinetic energy. In practice, it is customary to raise pressure to 20 atmospheres or more.

The maximum efficiency of a heat engine is $\epsilon=1-To/Ti$, which in our example=1−400/800=50%. In practice, the efficiency of conversion could be lower because of entropic increases for a higher outlet temperature To than the predicted Tc for reversible Carnot cycle of maximized efficiency. Nevertheless, a higher outlet temperature does not imply wasted heat, as the exhaust heat could be used for other purposes such as water heating and absorption chilling.

We now explore the volumetric expansion for the adiabatic process of the gas through the spiral of the turbine. The key thermodynamic relation governing volume and pressure is $PV^{\gamma}$=constant, with $\gamma=7/5$ for diatomic gas or 1.3 for steam. Compared with the isothermal process for which PV=constant, the adiabatic expansion of the gas is less than the isothermal expansion process, as the isothermal process absorbs heat from the environment in the process. Consider an inlet pressure of 20 atmospheres that is reduced to 1 atmosphere at the outlet. The volume of steam would have expanded by $20^{1/\gamma}$=10.02 times, about half as much as the isothermal process.

As pressure is essential for an efficient conversion of heat into motion, there still remains the question of how we may generate a high pressure at the inlet. To create the high pressure of a Rankine cycle, a high pressure low volume (typically a few cc per second of water) pump is used, generating a pressure of more than 20 atmospheres. The retaining of such a pressure within the boiler depends on the rate of steam generation as well as how much the generated steam is choked by a small inlet to the turbine.

The dynamics of pressure in response to heat input is self-regulating. As pressure increases due to large steam generation within the boiler, the boiling point of water increases thereby reducing steam generation, as more heat is required to raise the temperature of water prior to boiling at an elevated boiling point. In the reverse if pressure is reduced suddenly, a flash of steam is generated as the latent heat of water now provides the heat of evaporation for the less pressurized water. The increased volume of steam raises pressure when the steam is choked at the steam inlet. More steam also renders the steam less superheated by the same amount of heat.

In our experience, the steam inlet area Ai should be small, essentially a few square millimeters. We needed 10 KW or more of heat input to superheat 2 cc of water per second, as the total enthalpy of steam at 20 atmospheric pressure and 800 degrees Kelvin is about 3.5 KJ per cc of water. Not all heat generated by a heat source may be absorbed by the superheated steam.

At 20 atmospheric pressure and 800 degrees Kelvin, the volume of superheated steam generated by 2 cc of water is around 400 cc with a total enthalpy of 7 KJ. The inlet area Ai has to be small in order to create a backpressure. This volume of steam expands gradually as it passes through the spiral. We now continue to calculate the speed of steam Λi in the spiral, expecting that to be slow so that the lion's share of energy density is pressure in the total $Ei=Pi+\frac{1}{2}\Delta i\Lambda i^2$.

We have found by experimentation that the appropriate dimensioning of the spiral be less than 0.5 mm in depth and more than 1 cm in width. Since there are two spirals in FIG. 1, the total inlet area Ai=2WiDi~2×10 mm×0.5 mm=10=$^{2}$. Here, we have the length (~1 m) of the spiral much longer than its width (~1 cm), which in turn is much wider than its depth (<0.5 mm), so that there is a substantial area of length times width for the gas to exert force on.

The velocity of gas at the inlet is then 400 cc/s divided by 10 $mm^2$, or 4 m/s, which is small in kinetic energy ($\frac{1}{2}\Delta i\Lambda i^2$~44 Pa) relative to the pressure/temperature energy (Pi~2 million Pa) of the gas.

Throughout the spiral, the gas would not speed up, provided that the disks containing the spirals turn at a reasonable speed in the same direction as the gas flow. We now explain the fluid mechanics of gas flow in the spirals in the context of the Navier-Stokes equation.

We first explain how the shape of the spiral and the spinning of the spiral disk affect the trajectory of steam between inlet 501 and outlet 502 of the turbine. FIG. 5 illustrates the mathematical form of the spiral 503, expressing its radius r(θ) 504 as a function of the turn θ 505. The infinitesimal length dl 506 is shown. The full length of the spiral is the integration of dl from the initial θ=0 to the final θ, with θ measured in radians. The width and depth 507 of the spiral are of cm and mm scale. The width and depth of the spiral are kept constant throughout.

FIG. 6 shows a disk with two linear spirals 601 602 each of 5 turns. A linear spiral is defined by the equation $r(\theta)=b+c\theta$. The two spirals 601 602 are offset by half a cycle in turn. The spirals do not cross path as shown. The spiral has width W 603 and depth D 604 as shown. The linear spiral has the advantage that the spacing of the spirals is uniform, allowing a larger number of turns. More turns produce more impedance to the gas flow, preventing the gas from premature speeding up which we want to avoid. In our implementation shown in FIG. 2, we adopted a disk with a single spiral making ten turns, with $r(\theta)=10+2.50/\pi$ (mm) for $0<\theta<20\pi$. The initial and final radii are $r(0)=10$ mm and $r(20\pi)=60$ mm.

If we use wire EDM or water jet to cut through the disks to form two spirals, the disk would be separated into two parts as shown in FIG. 6. Holding the two parts together while maintaining a constant depth along the entire spiral would be difficult. The spiral may be cut out by computer numerical controlled (CNC) methods so that there is one solid piece. However, CNC milling cannot achieve sufficient precision with a channel of a cm width and less than mm depth as shown.

FIG. 7 shows a disk 701 with a single exponential spiral 702 with 3 turns. An exponential spiral has the equation $r(\theta)=a+be^{c\theta}$. The constants a, b, and c are affixed by the design of the initial radius 703, final radius 704, and the number of turns in between. The exponential spiral has many beneficial properties suitable for our turbine. First, the spiral is self-similar, i.e. an infinite inward spiral looks the same when zoomed into the center of the spiral. This self-similarity has the property that the flight path of the gas is at the same constant angle relative to the tangent of the spiral where the gas is. The exponential spiral has a biological analogy. Insects navigate by flying at an angle to sunlight. For a point source of light such as fire, such behavior would cause the insect to follow an exponential spiral flying towards the fire. Fortuitously, the gas in our turbine spirals outward, exerting force at a constant angle for an exponential spiral instead of a diminishing angle for a linear spiral.

We now consider the fluid dynamics of gas flow within the spiral channel of the rotating disk. The volume-pressure-temperature relations prescribed by thermodynamic theory of a gas in certain equilibrium were used earlier to calculate the theoretical thermodynamic efficiency.

While we have done analytical and simulation analysis of gas flow in the turbine, we describe here instead the nature of gas flow inside the turbine in an intuitive manner, as our theoretical and experimental studies of the turbine indicated.

We are mostly interested in understanding how pressure changes along the length of the spiral, for different angular velocity co of the turbine. As asserted before, we desire to have a gradual release of pressure along the entire length of the spiral without a sudden increase in speed of the gas. In our earlier example, we assumed 2 cc of water per second is superheated to 400 cc of steam at 800 degree Kelvin and 20 atmospheres of pressure (2 million Pa). This steam is injected into spirals of a total inlet area of 10 square millimeters, forcing the gas to flow at a relatively low velocity of 4 meters per second. The steam exits the turbine at 1 atmosphere of pressure. If the gas flow is thermodynamically reversible and adiabatic, we have calculated that the exit temperature would be about 400 degree Kelvin, and the gas would have expanded about 10 times in volume.

The rotation of the turbine changes the trajectory of gas flow, as gas is confined within the rotating spiral. Consider first a stationary turbine. No work is performed by the gas on the turbine. Due to the significant impedance of the spiral, the gas is forced to turn constantly through the many turns of the spiral. This impedance is due to spiraling of the gas flow keeping pressure high until the outlet. Pressure is suddenly released, resulting in a sudden acceleration of the gas. In experiments, a loud hissing sound is heard. Upon exit, the accelerated gas rapidly loses its kinetic energy to the ambient static air.

The gas flow causes a reaction by the turbine, making the turbine rotate in a reversed direction of the gas flow spiral. The motion of gas relative to a stationary observer becomes less circuitous, making the gas flow path somewhat straightened by the reverse motion of the turbine. There is a certain velocity $\omega^{max}$ of turbine spin when the gas appears to the stationary observer as not spinning. The gas appears to make a relatively straight travel from the center to outside of the turbine. To the outside observer, the gas makes a beeline exit from inlet to outlet, with most of the pressure of the gas relieved close to the inlet.

To illustrate this path straightening, let us assume that the gas spins at a constant angular velocity of $\omega_g$ relative to the spinning turbine. Let the turbine spin at a constant angular velocity of $\omega_t$ relative to a stationary observer. Subsequently, the angular velocity of the gas relative to the stationary observer is $\omega=\omega_g-\omega_t$. The angular velocity of the turbine reduces the angular velocity of the gas seen from the ground.

FIG. 8 plots pressure versus angles turned for the gas relative to the rotating turbine, therefore showing the variation of pressure along the length of the spiral. The two extreme cases are shown for $\omega=0$ and $\omega=\omega^{max}$, indicating respectively that pressure is relieved at the outlet and inlet of the spiral respectively. As the turbine starts to turn, the pressure curve shift from the case of $\omega=0$ (a concave curve) to that of $\omega=\omega^{max}$ (a convex curve). There is a particular $\omega=\omega^{critical}$ when the pressure curve is relatively straight. At that critical angular velocity, the gas performs work gradually along the entire length of the spiral.

At that critical angular velocity, exiting gas has spent pressure energy without much of that converted to kinetic energy or entropic heat at low pressure. From our experiments, gas exits quite gently with spent energy. There is neither a hissing sound nor a rushing gas flow.

The outward spiraling flow of gas has another appealing feature suitable for the adiabatic expansion of the gas. Consider the infinitesimal length dl of gas at radius $r(\theta)$ contained inside the infinitesimal angle $d\theta$. We have $dl=\sqrt{(r(\theta))^2+(dr(\theta)/d\theta)^2}d\theta$. As the gas travels outwards on the spiral with increasing $\theta$, it expands in volume as pressure is reduced by virtue of the gas working against the spiral wall. For both the linear and exponential spirals, the function $r(\theta)$ and its first derivative $dr(\theta)/d\theta$ are positive functions of $\theta$. Therefore, dl increases as $\theta$ increases. The gas expands within the expanding dl as it spirals outwards.

For the linear spiral shown in FIG. 2, we have $r(\theta)=10+2.5\theta/\pi$ for the ten turns made for $0<\theta<20\pi$. At the inlet of the spiral we have $r(0)=10$ mm. At the outlet with $r(20\pi)=60$ mm, the length dl has expanded by a factor of more than 6, close to the factor of 10 increase in volume for the gas as pressure is reduced from 20 atmospheres to 1 atmosphere.

For the exponential spiral shown in FIG. 7, the spiral turns tighter in the center and looser as it spirals outward. The exponential spiral, seen often in nature as spiral arms of galaxies and sea shell coils, has many interesting properties that are suitable for our turbine. First, the spiral is self-similar, in the sense that the spiral looks similar as we zoom into the center. Second, the exponential spiral has the nice property that the spiral arm has the same tangent angle with respect to the radial direction. Third and most important, the exponential expansion matches the exponential form governing adiabatic expansion of the gas governing pressure and volume, i.e. $PV^{\gamma}$=constant, where $\gamma$=1.3, 7/5, 5/3 for steam, diatomic gas, and mono-atomic gas respectively.

Expressing volume V as a function of pressure P, we have $$V_2 = V_1\left(\frac{P_1}{P_2}\right)^{1/\gamma}.$$

Thus as the gas spirals outward, volume increases exponentially. This matches well with the exponentially increasing length of the exponential spiral as a function of the number of turns made. Therefore, the exponential spiral may provide a more uniform expansion of the gas within the spiral.

Our analysis and experimental results indicate that for sufficient impedance to gas flow, the spiral should be of a width less than a millimeter and the spiral should be long with more than 3 turns. The precise shape of the spiral does not matter as long as it is generally tighter in the center than the peripheral.

Modifications, additions, or omissions may be made to the systems, apparatuses, and methods described herein without departing from the scope of the invention. The components of the systems and apparatuses may be integrated or separated. Moreover, the operations of the systems and apparatuses may be performed by more, fewer, or other components. The methods may include more, fewer, or other steps. Additionally, steps may be performed in any suitable order. As used in this document, "each" refers to each member of a set or each member of a subset of a set. To aid the Patent Office, and any readers of any patent issued on this application in interpreting the claims appended hereto, applicants wish to note that they do not intend any of the appended claims or claim elements to invoke paragraph 6 of 35 U.S.C. Section 112 as it exists on the date of filing hereof unless the words "means for" or "step for" are explicitly used in the particular claim.

We claim:

1. A turbine, comprising: a plurality of disks stacked coaxially each having a radially extending spiral having a width and a depth, the spiral of each said disk having an entrance configured to receive a high pressure gas at a center of the disk via a hollow spin axle and release the gas at an exit at a periphery of the disk, the spiral of each said disk configured to release a pressure of the gas gradually through multiple turns of the spiral, configured to cause the disk to rotate in an opposite direction of a turning of the gas by means of pressure.

2. The turbine as specified in claim 1 wherein the spiral of each said disk is configured to expand the gas adiabatically from the entrance to the periphery of the disk, dropping a temperature and the pressure of the gas gradually through multiple turns of the spiral, causing each of the one or more disks to rotate in the opposite direction of the turning of the gas by the means of pressure.

3. The turbine as specified in claim 2 wherein each said disk is solid and each of the spirals have multiple turns engraved in the respective disk, with the entrance and the exit of each said spiral having different phases from the other spirals.

4. The turbine as specified in claim 2 wherein the entrance comprises an opening configured to receive a first nozzle along an axis of the disk, the opening configured to operate as a bearing and enable the turbine to spin smoothly around the first nozzle, the first nozzle configured as a fixed axle of the turbine.

5. The turbine as specified in claim 2 wherein a radial distance of the spiral of each said disk increases linearly as an angle of the spiral turns from its entrance.

6. The turbine as specified in claim 2 wherein a radial distance of the spiral of each said disk increases exponentially as an angle of the spiral turns from its entrance.

7. The turbine as specified in claim 4 further comprising a cylindrical case containing each of the disks, with the first nozzle extending through a center top circular surface of the cylindrical case and configured to provide the pressurized gas to the disk, the container having an exit port configured to release the gas from each of the disks.

8. The turbine as specified in claim 7 further comprising a second nozzle extending through a center bottom circular surface of the cylindrical case and configured to also provide the pressurized gas to the entrance of each said disk, the first and second nozzles configured to balance pressure forces on the turbine.

9. The turbine as specified in claim 1 wherein the spiral has a length of at least 10 centimeters, the width is no greater than 1 centimeter, and the depth is no greater than 1 millimeter.

10. The turbine as specified in claim 2 wherein one said disk is coupled to a rotor of an induction electric motor, the disk comprising of a material of high magnetic susceptibility, wherein a top and a bottom surface of the disk is electrically conductive for induction of current by a changing magnetic field.

11. The turbine as specified in claim 8 wherein the case is configured as a stator of an induction motor and comprising of material of high magnetic susceptibility, further comprising a stator winding around a periphery of the case through which a changing magnetic field created by a rotor current on the disk induces an electric current in the stator winding, converting rotational energy of the turbine into electrical energy.

* * * * *